US010329909B2

(12) United States Patent
Seibert et al.

(10) Patent No.: US 10,329,909 B2
(45) Date of Patent: Jun. 25, 2019

(54) EDGE CUTTING ELEMENT FOR ROTATABLE CUTTING DRUM

(71) Applicant: VERMEER MANUFACTURING COMPANY, Pella, IA (US)

(72) Inventors: Joshua Seibert, Pella, IA (US); Edward Cutler, Bloomfield, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 15/525,374

(22) PCT Filed: Nov. 10, 2015

(86) PCT No.: PCT/US2015/059977
§ 371 (c)(1),
(2) Date: May 9, 2017

(87) PCT Pub. No.: WO2016/077363
PCT Pub. Date: May 19, 2016

(65) Prior Publication Data

US 2017/0335686 A1 Nov. 23, 2017

Related U.S. Application Data

(60) Provisional application No. 62/077,579, filed on Nov. 10, 2014.

(51) Int. Cl.
*E21C 25/10* (2006.01)
*E21C 35/19* (2006.01)
(Continued)

(52) U.S. Cl.
CPC ..... *E21C 35/19* (2013.01); *E21C 25/10* (2013.01); *E21C 35/18* (2013.01); *E01C 23/088* (2013.01)

(58) Field of Classification Search
CPC ..... E21C 35/19; E21C 25/10; E01C 23/088
See application file for complete search history.

(56) References Cited

U.S. PATENT DOCUMENTS 318,962 A 6/1885 Crump et al.
3,290,096 A 12/1966 Stalker
(Continued)

FOREIGN PATENT DOCUMENTS

DE 101 32 608 2/2006
EP 0 758 711 A2 2/1997
(Continued)

OTHER PUBLICATIONS

International Search Report and Written Opinion of the International Searching Authority for corresponding International Patent Application No. PCT/US2015/059977 dated Feb. 18, 2016, 21 pgs.
(Continued)

*Primary Examiner* — D. Andrews
*Assistant Examiner* — Dany E Akakpo
(74) *Attorney, Agent, or Firm* — Merchant & Gould P.C.

(57) ABSTRACT

A cutting element including an arcuate base having a first side, a second side, an outer radial surface, and an inner radial surface, the inner radial surface being configured to be mounted to a cutting drum. The cutting element also includes a plurality of tooth holders being mounted to the outer radial surface of the arcuate base, the tooth holders being configured to receive cutting teeth. Additionally, the cutting element includes a cutting tooth mounted in each tooth holder, wherein there is at least one leading tooth, and at least one trailing tooth, each of the cutting teeth being configured to cut through a dissimilar cutting plane, wherein each dissimilar cutting plane is parallel to one another.

24 Claims, 9 Drawing Sheets

(51) Int. Cl.
*E01C 23/088* (2006.01)
*E21C 35/18* (2006.01)

(56) References Cited

U.S. PATENT DOCUMENTS

| | | | |
|---|---|---|---|
| 3,325,219 | A | 6/1967 | Guillon et al. |
| 3,544,166 | A | 12/1970 | Proctor |
| 3,614,164 | A | 10/1971 | Davis |
| 3,627,381 | A | 12/1971 | Krekeler |
| 3,663,063 | A | 5/1972 | Johnmeyer, Sr. |
| 4,119,350 | A | 10/1978 | Sander et al. |
| 4,342,486 | A | 8/1982 | O'Neill |
| 4,669,786 | A | 6/1987 | Morgan et al. |
| 4,697,850 | A | 10/1987 | Tuneblom |
| 4,755,004 | A | 7/1988 | Palmquist et al. |
| 4,755,044 | A | 7/1988 | Palmquist et al. |
| 5,016,943 | A | 5/1991 | Wirtgen |
| 5,582,468 | A | 12/1996 | Latham |
| 5,639,180 | A | 6/1997 | Sulosky et al. |
| 5,647,641 | A | 7/1997 | Sulosky et al. |
| 5,879,109 | A | 3/1999 | Finzel et al. |
| 5,934,834 | A | 8/1999 | Perrot |
| 6,779,850 | B1 | 8/2004 | Schibeci et al. |
| 7,066,555 | B2 | 6/2006 | Hansen et al. |
| 7,290,360 | B2 | 11/2007 | Unzicker et al. |
| 7,475,949 | B2 | 1/2009 | Helsel et al. |
| D640,290 | S | 6/2011 | Stellman et al. |
| D640,291 | S | 6/2011 | Stellman et al. |
| D640,292 | S | 6/2011 | Stellman et al. |
| 8,375,605 | B2 | 2/2013 | Ruhl et al. |
| 8,480,332 | B2 | 7/2013 | Miller |
| 8,672,416 | B2 | 3/2014 | Wachsmann |
| 2002/0195869 | A1 | 12/2002 | Dybsetter et al. |
| 2004/0148823 | A1 | 8/2004 | Schenk |
| 2005/0146198 | A1 | 7/2005 | Hill et al. |
| 2006/0255649 | A1 | 11/2006 | Dawood |
| 2007/0056425 | A1 | 3/2007 | Bonar |
| 2008/0217986 | A1 | 9/2008 | Lebegue |
| 2008/0235997 | A1 | 10/2008 | Latham |
| 2008/0298755 | A1 | 12/2008 | Caplan et al. |
| 2009/0224596 | A1 | 9/2009 | Cooper et al. |
| 2009/0256413 | A1 | 10/2009 | Majagi et al. |
| 2009/0302668 | A1 | 12/2009 | Stratti |
| 2010/0086254 | A1 | 4/2010 | Dofher |
| 2010/0288098 | A1 | 11/2010 | Matsuura |
| 2011/0241408 | A1* | 10/2011 | Wachsnnann ..... B28D 1/18 299/39.4 |
| 2013/0033085 | A1 | 2/2013 | Wade et al. |
| 2013/0145657 | A1 | 6/2013 | Ruhl et al. |
| 2014/0013634 | A1 | 1/2014 | Huber |
| 2014/0239700 | A1 | 8/2014 | Wachsmann |
| 2015/0035342 | A1 | 2/2015 | Jonker et al. |

FOREIGN PATENT DOCUMENTS

| | | | |
|---|---|---|---|
| FR | 2 732 051 | A1 | 9/1996 |
| WO | 2008/063977 | A2 | 5/2008 |
| WO | 2012/030994 | A2 | 3/2012 |

OTHER PUBLICATIONS

"BC 40 Trench Cutter; Cutting Wheels", Bauer Maschinen GmbH, Jul. 2011, 6 pgs.
"Cutting Tools and Blocks", Admitted Prior Art as of Nov. 15, 2013, 1 pg.
"Trenching & Leveling Block Systems and Accessories", Solid, Kennametal, 2010, 8 pgs.
"Trenching Tools", Solid, Kennametal, 2010, 8 pgs.
"Trenching, Vermeer-Earth Saw Segments", Keystone Engineering, Sep. 19, 2013, 3 pgs.

* cited by examiner

EDGE CUTTING ELEMENT FOR ROTATABLE CUTTING DRUM

This application is a National Stage Application of PCT/US2015/059977, filed Nov. 10, 2015, which claims benefit of U.S. Provisional Patent Application No. 62/077,579, filed Nov. 10, 2014, the disclosures of which are hereby incorporated by reference herein in their entireties. To the extent appropriate, a claim of priority is made to each of the above disclosed applications.

TECHNICAL FIELD

The present disclosure relates generally to a replaceable cutting apparatus for mounting reducing elements used by excavation machines such as surface excavation machines.

BACKGROUND

Relatively hard materials are often processed for mining and construction. The variety of materials include rock, concrete, asphalt, coal, and a variety of other types of mineral-based materials. A number of different methods for reducing the size of these hard materials have been developed. One traditional material size reduction method has been to drill relatively small holes in the material which are then packed with an explosive that is ignited, resulting in a rapid and cost effective method of size reduction. However, there are a variety of disadvantages to this technique, including the inherent risk of injuries, the production of undesirable noise, vibrations, and dust, and the fact that this process is difficult to utilize in situations where space is limited or where there is a potential risk of causing other gases to ignite.

Due to the above-described disadvantages associated with blasting techniques, alternative methods have been developed for reducing large surface areas of relatively hard materials. One alternative has been the use of reducing machines having rotary reducing components that move rigid and specialized reducing elements through paths of travel. The reducing components can include rotating cutting drums that move the reducing elements through circular paths of travel. Such drums are typically attached to corresponding machines with a mechanism that allows the position and orientation of the drum to be controlled, so as to bring the reducing elements into contact with the material being reduced.

An example machine of the type described above is disclosed in U.S. Pat. No. 7,290,360. The disclosed machine is a surface excavation machine used for applications such as surface mining, demolishing roads, terrain leveling, and prepping sites for new construction or reconstruction by removing one or more layers of material. Surface excavation machines of this type provide an economical alternative to blasting and hammering and provide the advantage of generating a consistent output material after a single pass.

On some rotating cutting drums, certain cutting patterns, created by particular arrangements of the reducing elements along the surface of the drum, are used to achieve different cutting results. This is done for a variety of reasons, for instance to counter dust production and to achieve smoother cutting operation of the rotating cutting drum. See U.S. Patent Pub. No. 2006/0255649 and U.S. Pat. No. 4,119,350.

SUMMARY

In accordance with the following disclosure, the above and other issues are addressed by the following.

During some types of surface mining, consecutive mining passes are made on the same large surface. Therefore, for each pass, one side of the rotating cutting drum is cutting a new ditch while the opposite side passes through previously cut material. The side of the rotating cutting drum that cuts the new ditch is subjected to a high digging force, while the side of the rotating cutting drum that passes through the previously cut material is subjected to a high abrasion force. Because of these high forces, the rotating cutting drum, and parts attached to it, tend to wear over time and can be very costly to, replace. Therefore, there is a need to protect the rotating cutting drum, specifically the edges thereof, to minimize such wear.

According to an example aspect, the disclosure is directed to a cutting element that includes an arcuate base having a forward end, a rearward end, and an elongate axis; the arcuate base further having an outer radial surface and a first and second side, the first and second sides being parallel to the elongate axis. The cutting element also includes three tooth holders being mounted to the outer radial surface of the arcuate base, the tooth holders being configured to receive cutting teeth. Further, the cutting element includes a cutting tooth mounted in each tooth holder, wherein there is a leading tooth adjacent the forward end of the arcuate base, a trailing tooth adjacent the rearward end of the arcuate base, and an intermediate tooth disposed between the leading tooth and the trailing tooth. Each of the cutting teeth defines a respective tooth central axis, each tooth being mounted in a given tooth holder so as to be rotatable about the tooth central axis thereof. The tooth central axis of the leading tooth is configured to point at least partially in a first axial direction toward the first side of the arcuate base, at least partially in a first tangential direction toward the forward end of the arcuate base, and at least partially in a first radial direction away from the outer radial surface. The tooth central axis of the trailing tooth is configured point at least partially in a second axial direction toward the second side of the arcuate base, at least partially in a second tangential direction toward the forward end of the arcuate base, and at least partially in a second radial direction away from the outer radial surface. The tooth central axis of the intermediate tooth is configured to point at least partially in a third axial direction between the first axial direction and the second axial direction, at least partially in a third tangential direction between the first tangential direction and the second tangential direction, and at least partially in a third radial direction away from the outer radial surface.

According to another aspect, the disclosure is directed to a cutting element including an arcuate base having a first side, a second side, an outer radial surface, and an inner radial surface, the inner radial surface being configured to be mounted to a cutting drum. The cutting element also includes a plurality of tooth holders being mounted to the outer radial surface of the arcuate base, the tooth holders being configured to receive cutting teeth. Additionally, the cutting element includes a cutting tooth mounted in each tooth holder, wherein there is at least one leading tooth, and at least one trailing tooth. Each of the cutting teeth is configured to cut through a dissimilar cutting plane, wherein each dissimilar cutting plane is parallel to one another.

According to yet another aspect, the disclosure is directed to a cutting arrangement for a cutting drum that includes a plurality of edge cutting elements defining a cutting edge, the cutting edge being adjacent a side edge of the cutting drum, each edge cutting element including an arcuate base having a first side surface, a second side surface, an outer radial surface, and an inner radial surface, the inner radial surface being configured to be mounted to a cutting drum. The edge cutting element also includes three cutting tooth holders mounted to the outer radial surface of the arcuate base, the tooth holders being configured to receive cutting teeth. Also, the edge cutting element includes a respective cutting tooth mounted in each tooth holder, wherein there is a leading tooth, a trailing tooth and an intermediate tooth. Each of the cutting teeth is configured to cut through a dissimilar cutting plane, wherein each dissimilar cutting plane is parallel to one another. Each leading tooth of each edge cutting element overhangs the side edge of the cutting drum, and the plurality of edge cutting elements are arranged to cut a repeating pattern about every 45 degrees of rotation of the cutting drum.

According to yet another aspect, the disclosure is directed to a cutting element that includes an arcuate base having a first side surface, a second side surface, an outer radial surface, and an inner radial surface, the inner radial surface being configured to be mounted to a cutting drum. The cutting element further including three cutting tooth holders being mounted to the outer radial surface of the arcuate base, the tooth holders being configured to receive cutting teeth. The cutting element also including a respective cutting tooth mounted in each tooth holder, wherein there is a leading tooth, a trailing tooth and an intermediate tooth. Each of the cutting teeth is configured to cut through a dissimilar cutting plane, wherein each dissimilar cutting plane is parallel to one another and wherein the dissimilar cutting planes are equidistantly spaced apart;

According to yet another aspect, the disclosure is directed to a cutting arrangement that includes a cutting drum, the cutting drum having two side edges, a middle portion, and a rotational cutting direction. The cutting arrangement also includes a plurality of edge cutting elements defining a cutting edge, the cutting edge being adjacent a side edge of the cutting drum, each edge cutting element including an arcuate base having a first side, a second side, an outer radial surface, and an inner radial surface, the inner radial surface being configured to be mounted to the cutting drum. Each edge cutting element includes a plurality of tooth holders mounted to the outer radial surface of the arcuate base, the tooth holders being configured to receive cutting teeth, and a cutting tooth mounted in each tooth holder, wherein there is a leading tooth, a trailing tooth and an intermediate tooth. Each of the cutting teeth defines a respective tooth central axis, each tooth being mounted in a given tooth holder so as to be rotatable about the tooth central axis thereof. The tooth central axis of the leading tooth is configured to point at least partially in a first axial direction away from the middle of the cutting drum and at least partially in the rotational cutting direction of the cutting drum. The tooth central axis of the trailing tooth is configured to point at least partially in a second axial direction toward the middle of the cutting drum and at least partially in the rotational cutting direction of the cutting drum. The tooth central axis of the intermediate tooth is configured to point at least partially in a third axial direction between the first axial direction and the second axial direction and at least partially in the rotational cutting direction of the cutting drum.

According to yet another aspect, the disclosure is directed to a cutting element including an arcuate base having a forward end, a rearward end, and an outer radial surface; the arcuate base further defining a length, the length being bisected by a vertical reference plane that runs along the length. The cutting element also includes three tooth holders being mounted to the outer radial surface of the arcuate base, the tooth holders being configured to receive respective cutting teeth. Further, the cutting element includes a cutting tooth mounted in each tooth holder, wherein there is a leading tooth adjacent the forward end of the arcuate base, a trailing tooth adjacent the rearward end of the arcuate base, and an at least one intermediate tooth disposed between the leading tooth and the trailing tooth, with each of the cutting teeth having a tooth tip. The tooth tip of the leading tooth defines a first tooth tip location, the first tooth tip location being offset in a first direction from the vertical reference plane. The tooth tip of the trailing tooth defines a second tooth tip location, the second tooth tip location being offset in a second direction from the vertical reference plane, the second direction being opposite from the first direction. The tooth tip of the at least one intermediate tooth defines a third tooth tip location relative to the vertical reference plan, the third tooth tip location being between the first and second tooth tip locations.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
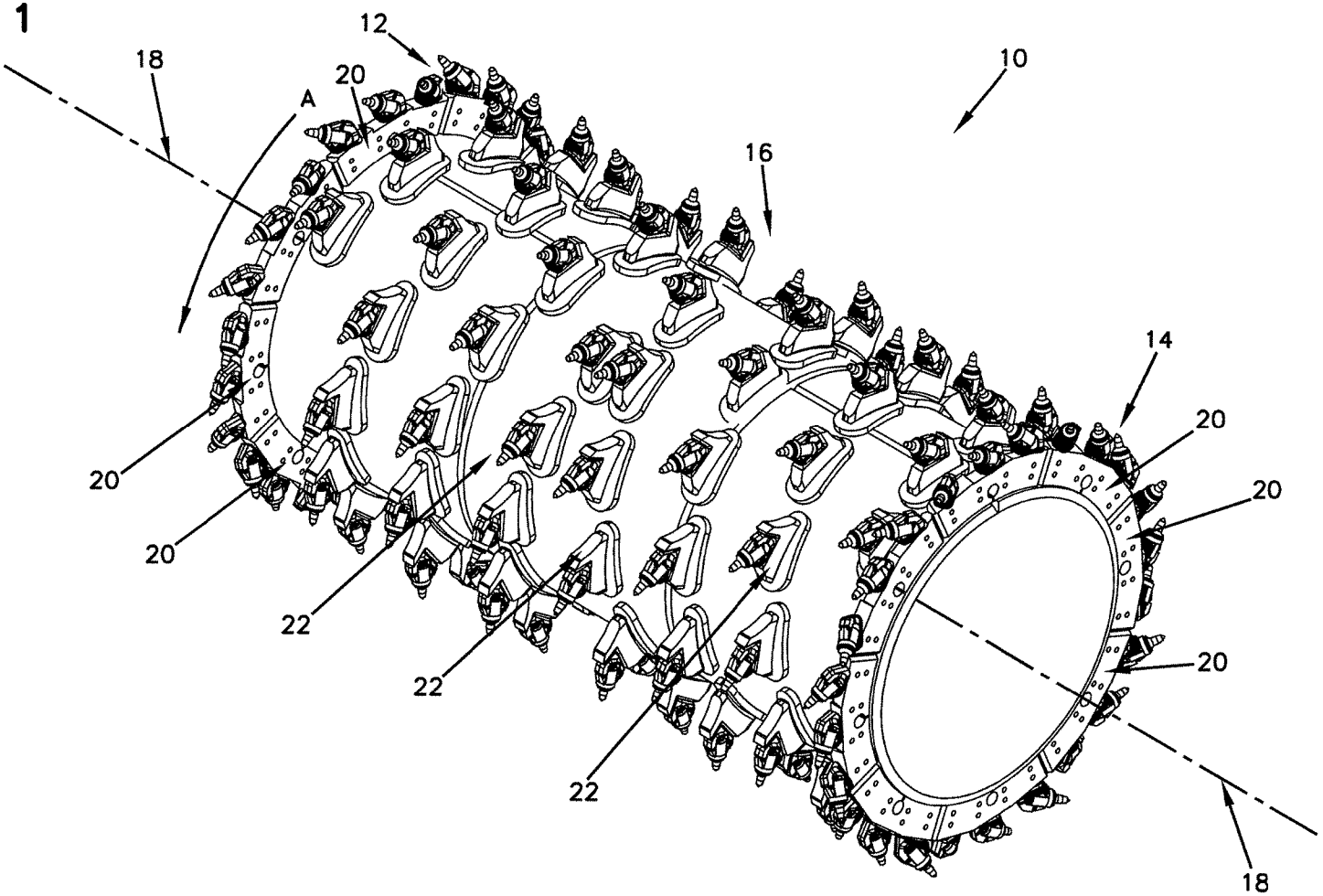
FIG. 1 illustrates a perspective view of a rotatable cutting drum of a surface excavation machine, in accordance with the principles of the present disclosure.

Various embodiments of the present invention will be described in detail with reference to the drawings, wherein like reference numerals represent like parts and assemblies throughout the several views. Reference to various embodiments does not limit the scope of the disclosure.

The present disclosure describes, generally, an edge cutting system for a rotatable cutting drum. The edge cutting system disclosed herein is configured to reduce wear on the edges of the rotating cutting drum and to clear material that lies beyond the edge of the rotating cutting drum. Additionally, the edge cutting system is configured to provide an efficient cutting pattern.

Figure 2:
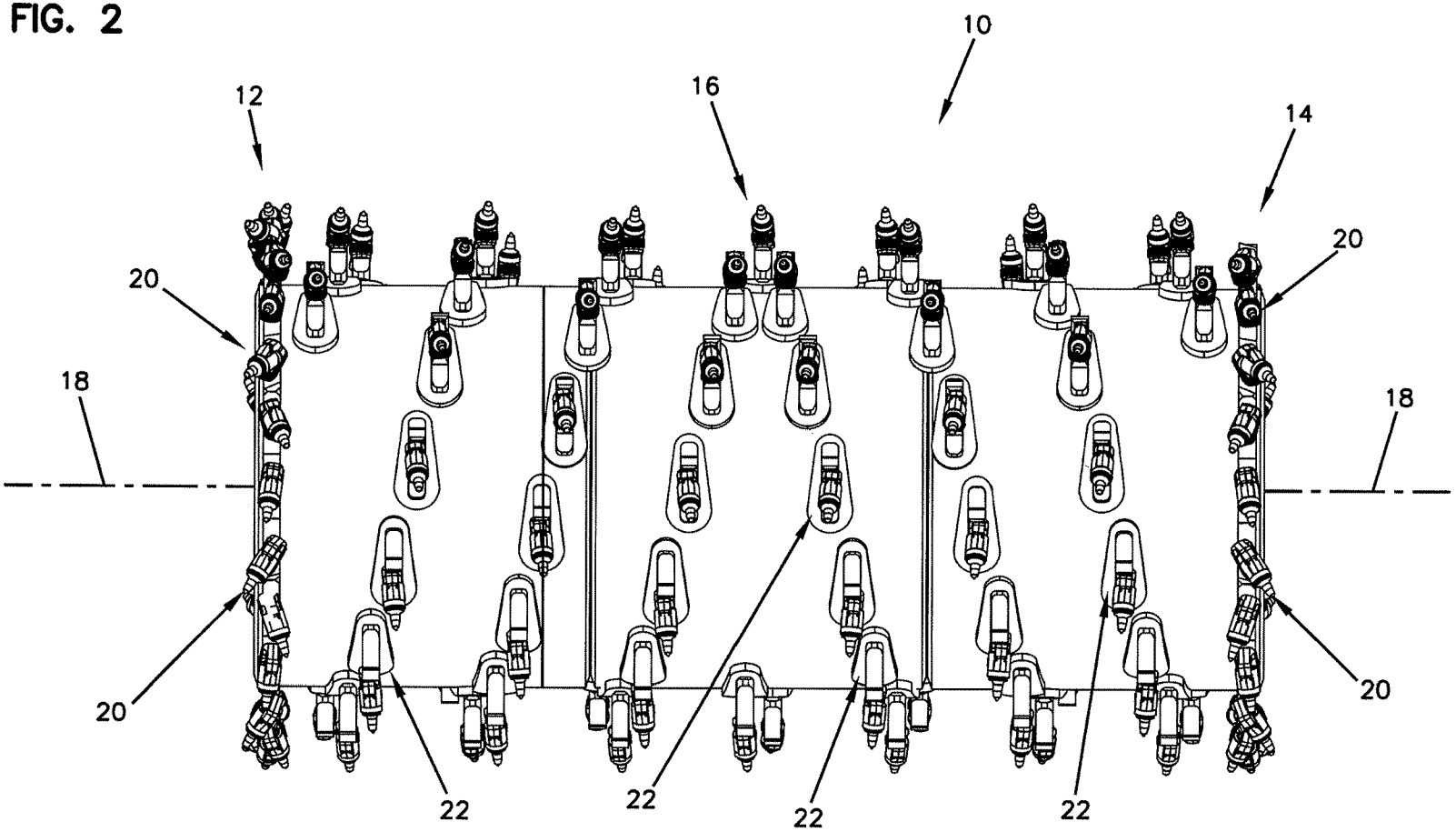
FIG. 2 illustrates a front view of the rotatable cutting drum shown in FIG. 1.

FIG. 1 and FIG. 2 show a rotatable cutting drum 10. The rotatable cutting drum 10 has a first edge 12, a second edge 14, and a center portion 16. The rotatable cutting drum 10 can be rotatable about a central axis 18 and have a rotatable cutting direction A. Further, the rotatable cutting drum 10 can be equipped with a plurality of edge cutting elements 20 and a plurality of interior cutting elements 22 secured to the rotatable cutting drum's surface 11. The plurality of individually replaceable edge cutting elements 20 and the plurality of interior cutting elements 22 are configured to, together, break down material when the drum is rotated in a mining, or like activity, operation. Additionally, the edge cutting elements 20 and the interior cutting elements 22 together create a specific cutting pattern as the rotatable cutting drum 10 is rotated.

Figure 3:
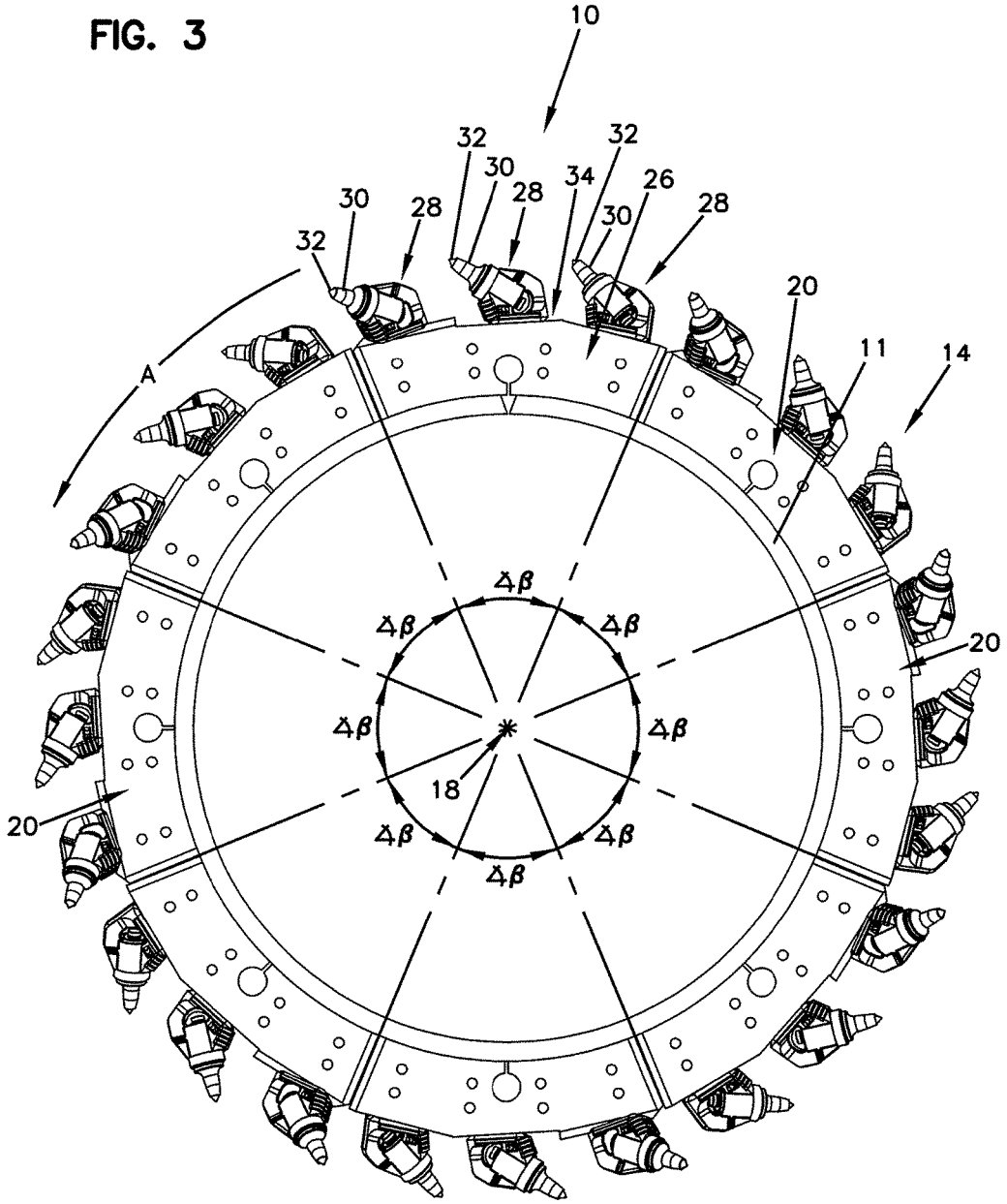
FIG. 3 illustrates a right side view of the rotatable cutting drum shown in FIG. 1.

FIG. 3 shows a right side view of the rotatable cutting drum 10. In the depicted embodiment, a series of eight edge cutting elements 20 are secured to the rotatable cutting drum's surface 11 at the second edge 14. In other embodiments, depending on the dimensions of the rotatable cutting drum and the edge cutting elements, the rotatable cutting drum can include more or less edge cutting elements. As shown, the rotatable cutting drum 10 has a circular cross-section having 360 degrees about an axis of rotation. In some embodiments, each edge cutting element 20 can be configured and otherwise arranged on the surface 11 of the rotatable cutting drum 10 so that each edge cutting element 20 occupies B degrees about the axis of rotation. In some embodiments, each edge cutting element 20 can occupy about 45 degrees about the axis of rotation of the rotatable cutting drum 10.

Each edge cutting element 20 can comprise an arcuate base 26. The arcuate base 26 may be made of steel or other like wear resistant material. The edge cutting elements 20 can also include a series of tooth holders 28 secured to an outer radial surface 34 of the arcuate base 26. Within each tooth holder 28, a tooth 30 can be secured. In some embodiments, the tooth 30 can be rotatable within each tooth holder 28. In other embodiments, each tooth 30 can be secured within each tooth holder 28 so as not to rotate. Each tooth 30 can also be configured to have a tooth tip 32. Further, in some embodiments, each tooth 30 can be oriented so that its corresponding tooth tip 32 faces at least partially in the rotatable cutting direction A.

Figure 4:
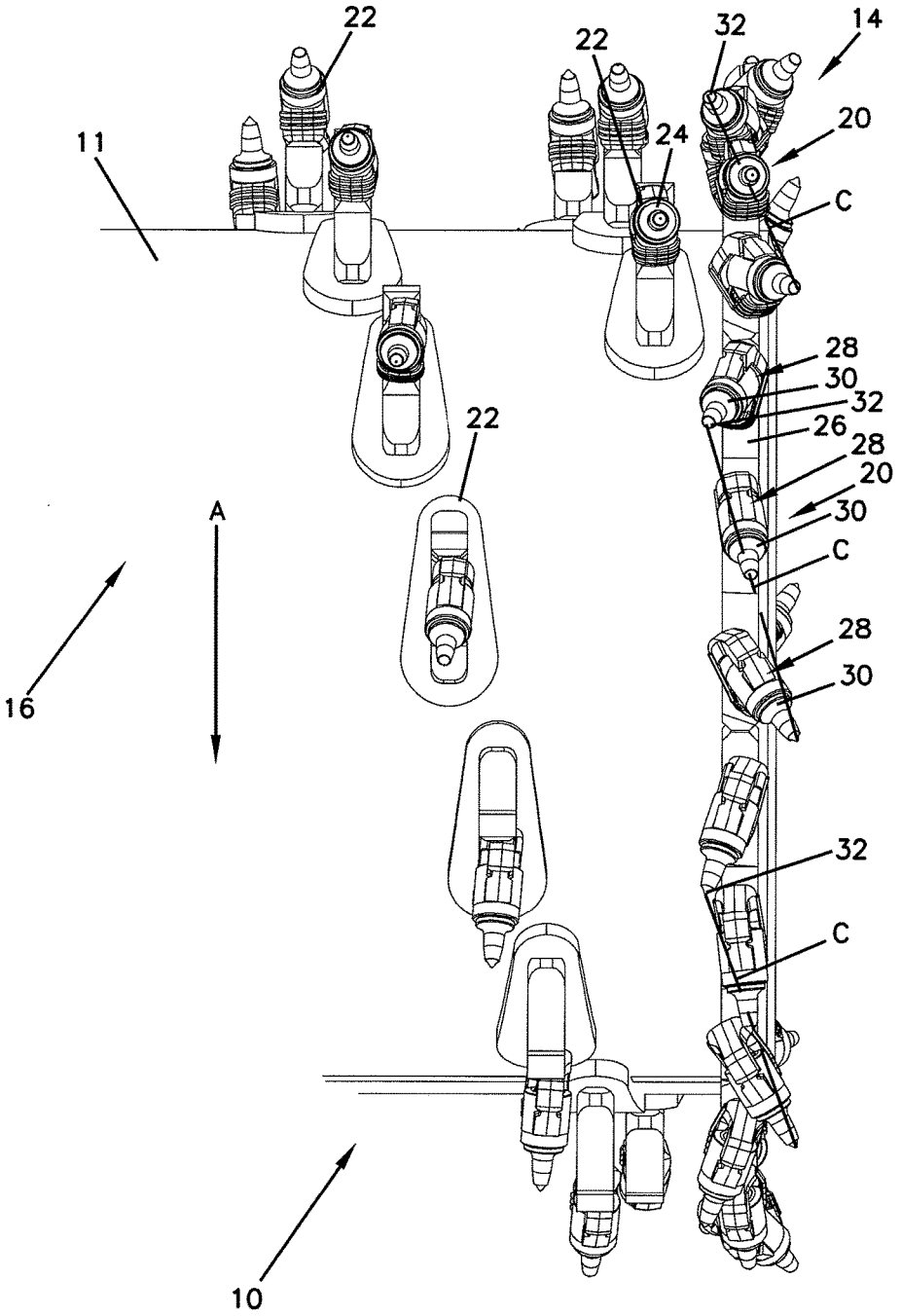
FIG. 4 illustrates a schematic drawing of the right edge region of the rotatable cutting drum of FIG. 1.

FIG. 4 shows a portion of the front side of the rotatable cutting drum 10, specifically a portion near the second edge 14. As shown, the interior cutting elements 22 can be arranged in a specific pattern, for example a spiral or series of spirals, around the rotatable cutting drum 10. The interior element that is positioned near the second edge 14, generally adjacent the series of edge cutting elements 20, is the closest interior cutting element 24. The edge cutting elements 20 can also be configured to cut in a specific pattern. In the depicted embodiment, line C represents the cutting pattern that each edge cutting element 20 takes, wherein a series of the cutting patterns C create an edge cutting pattern. The cutting pattern C can be a line that connects each tooth tip 32 on each edge cutting element 20. One advantage of the depicted edge cutting pattern C is that, during rotation of the rotatable cutting drum 10 in the cutting direction A, the cutting pattern progresses in a direction from the second edge 14 of the rotatable cutting drum 10 towards the center portion 16 of the rotatable cutting drum 10 allowing for improved clearing of material. This improved clearing of material for each edge cutting element 20 can reduce wear on following edge cutting elements 20. Additionally, the depicted cutting pattern C creates a sweeping motion, thereby moving material from the second edge 14 of the rotatable cutting drum 10, in a direction towards the center portion 16 of the rotatable cutting drum 10. While only the second side 14 of the rotatable cutting drum 10 is depicted, the first side 12 can be a mirror image of the arrangement shown on the second side 14.

Figure 5:
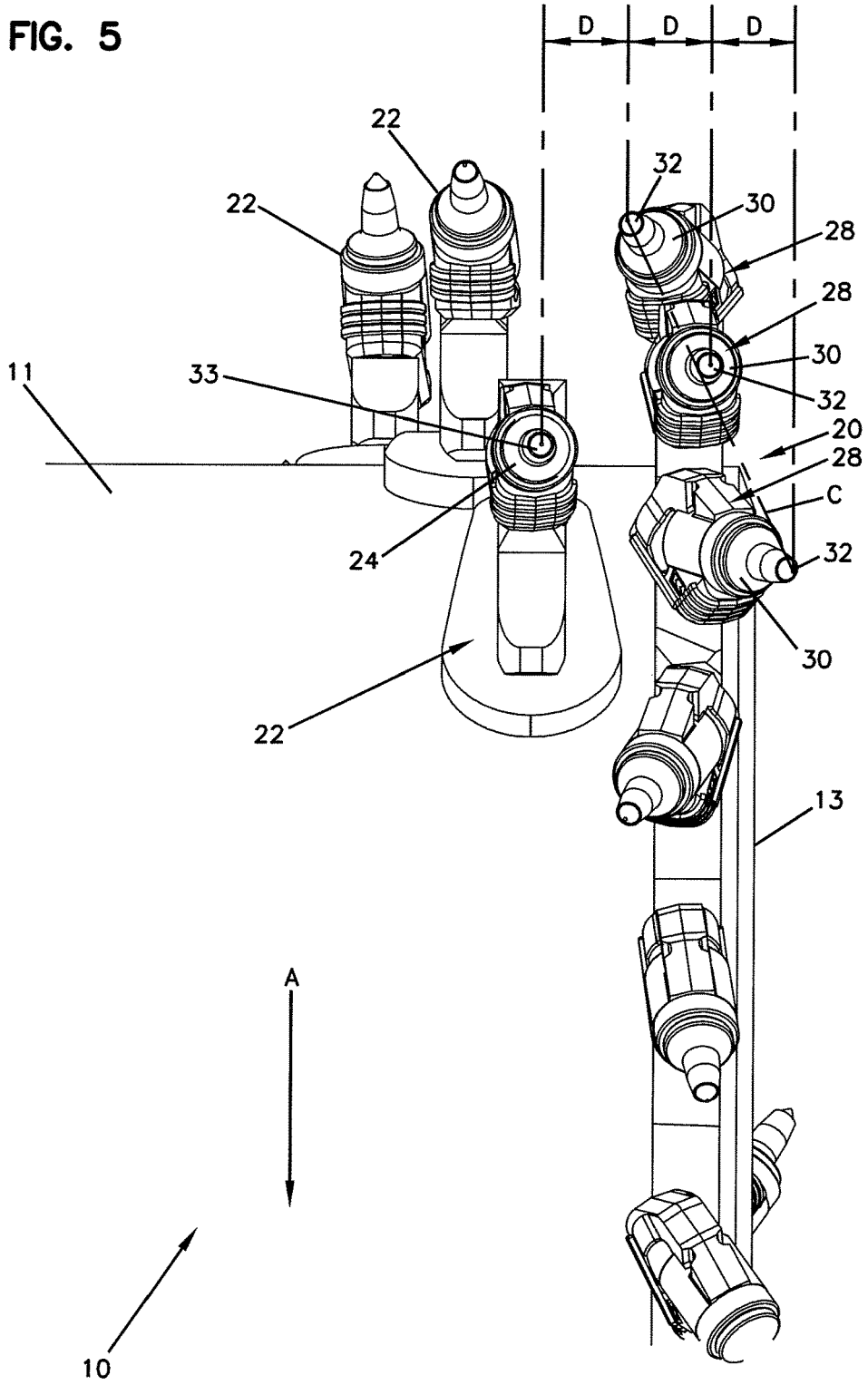
FIG. 5 illustrates a schematic drawing of a portion of the right edge region of the rotatable cutting drum of FIG. 1.

FIG. 5 shows a front view of the rotatable cutting drum depicted in FIG. 1. The view specifically shows a portion of the second edge 14 and a portion of the rotatable cutting drum 10. Additionally, some, but not all, interior cutting elements 22 are depicted, along with the closest interior cutting element 24. As shown, the tooth tips 32 of each cutting element 20 can be substantially equidistantly spaced at a distance D measured in a direction parallel to the axis of rotation of the rotatable cutting drum 10. In some embodiments, the spacing D may differ across the cutting element by between about 0% and about 20%. In other embodiments, the spacing D may differ across the cutting element by about 10%. In other embodiments still, the spacing D may differ across the cutting element by between about 0% and about 5%. In some embodiments, the distance D can vary across the cutting element. Further, in some embodiments, the edge cutting element 20 can have one or more tooth tips 32 overhanging the outer edge 13 of the rotatable cutting drum 10. Also, in some embodiments, a tooth tip 33 of the closest interior cutting element 24 can be spaced at the same distance D away from the closest edge cutting element tooth tip 32. In some embodiments, the spacing D may be chosen to be between about 2.00 inches and about 4.00 inches. In other embodiments, the spacing D can be about 3.77 inches.

The spacing D can affect the cutting pattern C, in addition to the overall edge cutting pattern. In some embodiments, the edge cutting pattern, the pattern created by a series of individual cutting patterns C, can have a series of minor offsets D between tooth tips 32 followed by a major offset, the major offset can be equal to two times the distance D between tooth tips (hereinafter 2D). The major offset 2D can occur when the edge cutting pattern transitions between cutting elements 20. The major offset 2D is the spacing that separates the final tooth 32 on one cutting element 20 and the first tooth 32 on an immediately following cutting element 20. In other embodiments where the edge cutting element has four teeth, the major offset distance see can be equal to three times the distance D.

Figure 6:
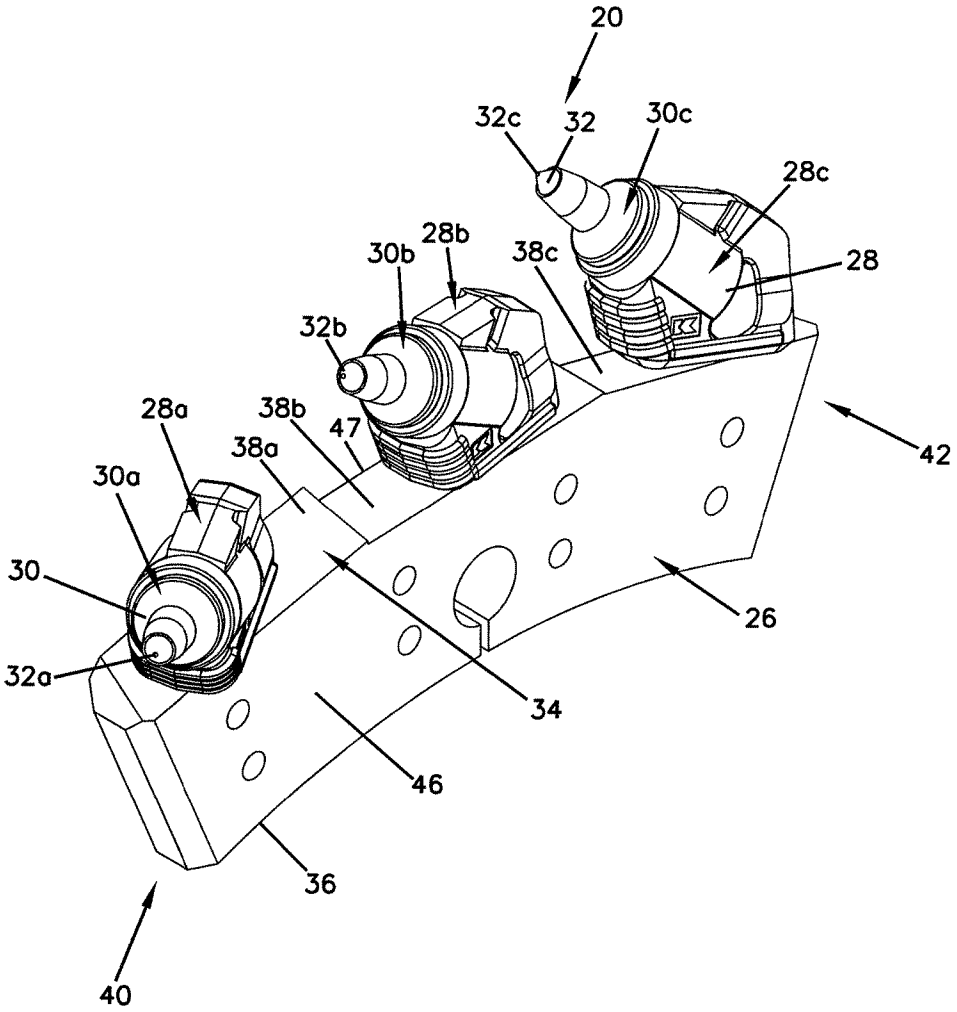
FIG. 6 illustrates a perspective view of the edge cutting element, according to one embodiment of the present disclosure, shown in FIG. 1.
Figure 7:
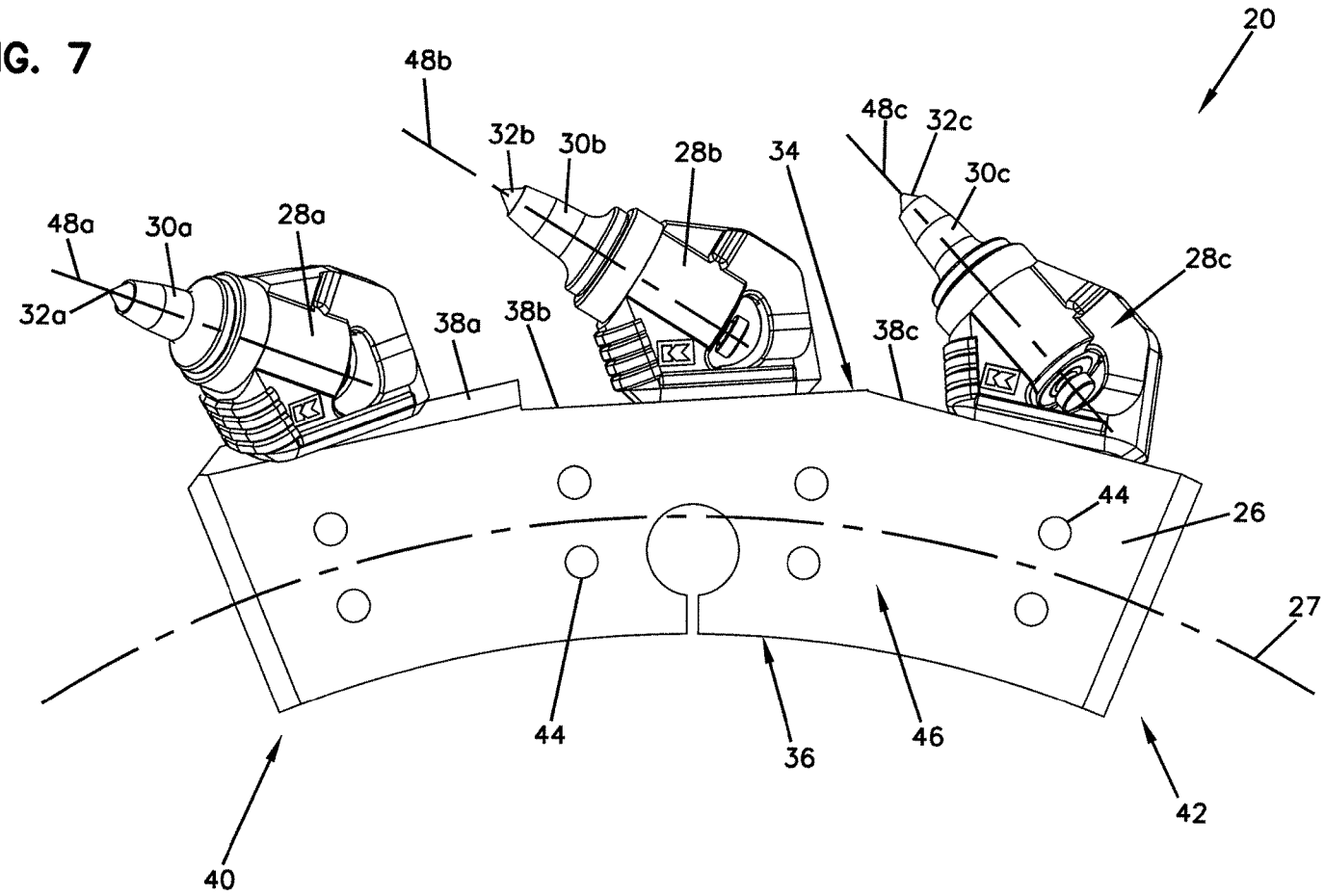
FIG. 7 illustrates a side view of the edge cutting element shown in FIG. 6.

FIGS. 6 and 7 show isometric and side views of the edge cutting element 20, respectively. The depicted edge cutting element 20 is configured to be secured to the surface of the second edge 14 of the rotatable cutting drum 10. An edge cutting element secured to the first edge 12 can be a mirror image of the edge cutting element 20 secured to the second edge 14. The edge cutting element 20 can have an elongate axis 27, a forward end 40 and a rearward end 42. The arcuate base 26 of the edge cutting element 20 further defines a first side 46 and a second side 47. In some embodiments, the arcuate base 26 can include an inner radial surface 36 that can be arc shaped so to be mounted to a surface of a rotatable cutting drum. Further, the arcuate base 26 of the edge cutting element 20 can include an outer radial surface 34 including a plurality of discrete mounting surfaces 38*a*, 38*b*, 38*c*, all angled relative to one another. In some embodiments, the edge cutting element 20 can have a leading tooth mounting surface 38*a*, adjacent the forward end 40 of the arcuate base 26, a trailing tooth mounting surface 38*c*, adjacent the rearward end 42 of the arcuate base 26, and an intermediate tooth mounting surface 38*b*, positioned between the leading tooth mounting surface 38*a* and the trailing tooth mounting surface 38*c*. The mounting surfaces 38*a*, 38*b*, 38*c* can each define a separate mounting plane. The plane defined by leading tooth mounting surface 38*a* can be orientated to face at least partially in a direction toward the first side 46 of the arcuate base 26. The plane defined by trailing tooth mounting surface 38*c* can be orientated to face at least partially in a direction toward the second side 47 of the arcuate base 26. The plane defined by second mounting tooth surface 38*b* can face a direction perpendicular to an elongate axis 27 of the arcuate base 26.

Each mounting surface 38*a*, 38*b*, 38*c* can be configured to hold a tooth holder 28 (e.g. 28*a*, 28*b*, 28*c*), each tooth holder 28 being configured to secure a respective tooth 30 (e.g. 30*a*, 30*b*, 30*c*) within each corresponding tooth holder 28. In some embodiments, the edge cutting element 20 can have a leading tooth 30*a*, an intermediate tooth 30*b* and a trailing tooth 30*c*. The leading tooth 30*a* can be adjacent the forward end 40 of the edge cutting element 20, the trailing tooth 30*c* can be adjacent the rearward end 42, and the intermediate tooth 30*b* can be positioned between the leading tooth 30*a* and the trailing tooth 30*c*. In some embodiments, the edge cutting element 20 can include a plurality of intermediate teeth 30*b*.

Each tooth 30 can be configured to have a tooth tip 32 (e.g. 32*a*, 32*b*, 32*c*). In some embodiments, the tooth tip 32 may be made of a material that is more wear resistant than the rest of the tooth (for example, made of a more wear resistant steel, made of a different alloy the rest of the tooth, or provided with a hardfacing layer etc.). In some embodiments, the tooth tip 32 of each tooth 30 can face at least partially in a direction toward the forward end 40 of the edge cutting element 20. Each of the cutting teeth 30 can define a respective tooth central axis 48*a*, 48*b*, 48*c*. In some embodiments, each tooth 30 can be mounted in a respective tooth holder 28 so as to be rotatable about the tooth central axis thereof.

In some embodiments, the arcuate base 26 can include a plurality of fastener holes 44. The fastener holes 44 can be used to secure external wear elements to further protect the arcuate base 26 of the edge cutting element 20 from extensive wear.

Figure 8:
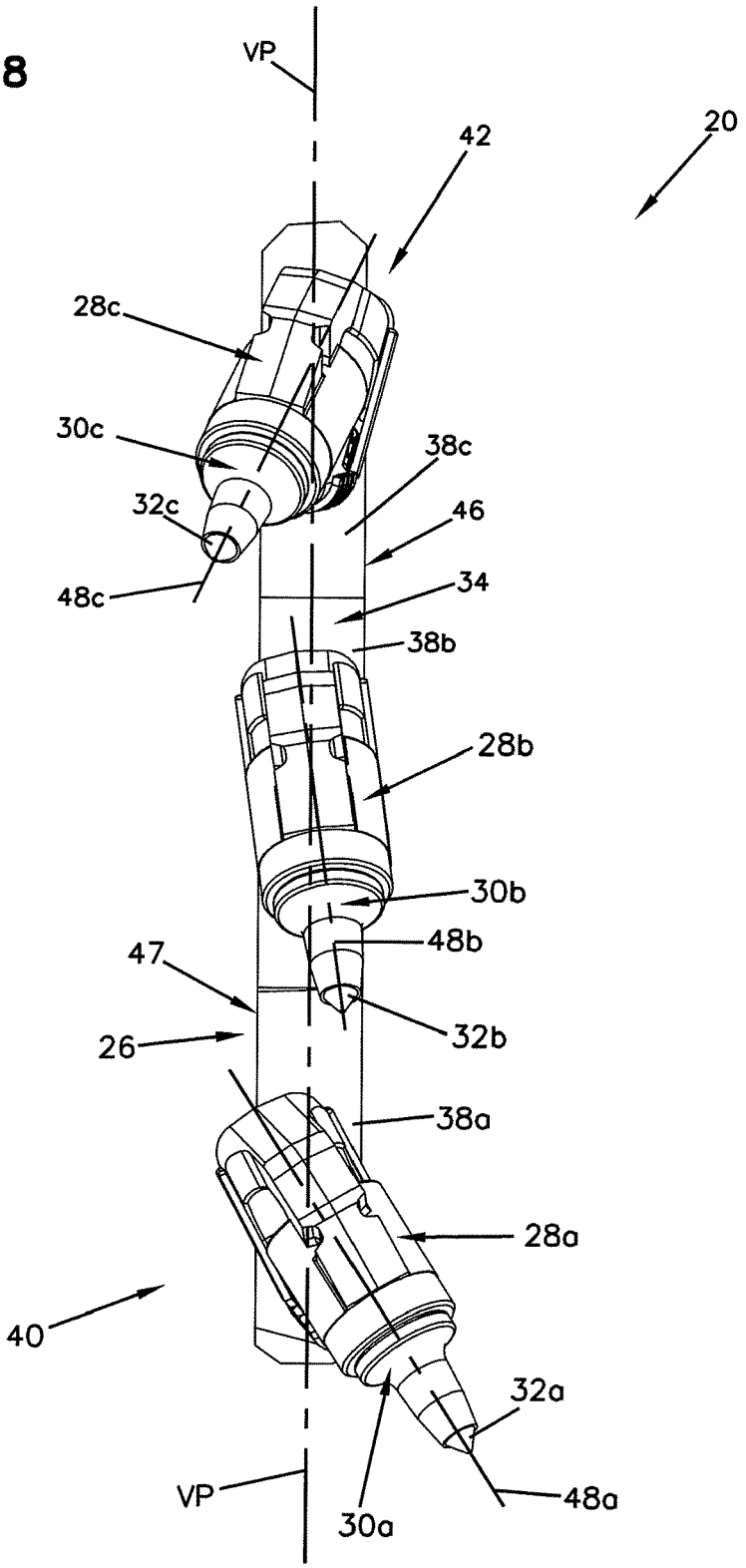
FIG. 8 illustrates a top view of the edge cutting element shown in FIG. 6.

FIG. 8 shows a top view of the edge cutting element 20. The edge cutting element 20, specifically the arcuate base 26, can have a length and a width. In some embodiments, a vertical reference plane VP can bisect the width of the arcuate base 26, running along the length of the arcuate base 26 along the elongate axis 27. In some embodiments, the leading tooth tip 32*a* may be offset from the vertical reference plane VP in a first direction. In the depicted embodiment, the first direction can be in a direction toward the first side 46 of the arcuate base 26. Also, in some embodiments, the trailing tooth tip 32*c* may be offset from the vertical reference plane VP in a second direction, opposite of the first direction. In the depicted embodiment, the second direction can be in a direction toward the second side 47 of the arcuate base 26. The intermediate tooth tip 32*b* can be at a location between the leading and trailing tooth tips 32*a*, 32*c* relative to the vertical reference plan VP.

As shown, the tooth central axis 48*a* can be a leading tooth central axis. The leading tooth central axis 48*a* can be configured to point at least partially in an axial direction toward the first side 46 of the arcuate base 26, at least partially in a tangential direction toward the forward end 40 of the arcuate base 26, and at least partially in a radial direction away from the outer radial surface 34.

The tooth central axis 48*c* can be a trailing tooth central axis. The trailing tooth central axis 48*c* can be configured point at least partially in an axial direction toward the second side 47 of the arcuate base 26, at least partially in a tangential direction toward the forward end 40 of the arcuate base 26, and at least partially in a radial direction away from the outer radial surface 34.

Further, the tooth central axis 48*b* can be an intermediate tooth central axis. The intermediate tooth central axis 48 can be configured to point at least partially in an axial direction between the axial direction of the leading tooth central axis 48*a* and the axial direction of the trailing tooth central axis 48*c*, at least partially in a tangential direction between the tangential direction of the leading tooth central axis 48*a* and the tangential direction of the trailing tooth central axis 48*c*, and at least partially in a radial direction away from the outer radial surface 34.

Figure 9:
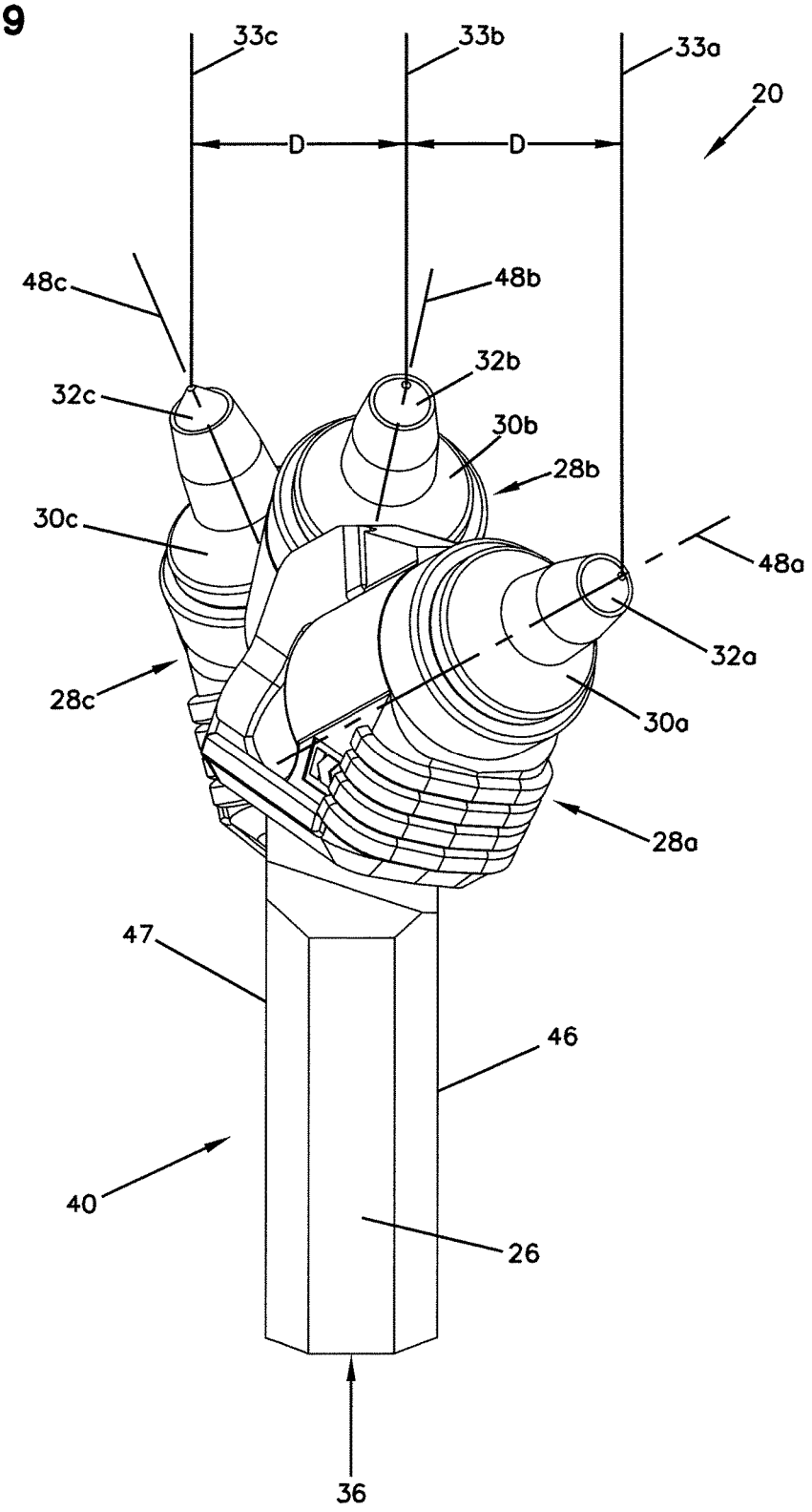
FIG. 9 illustrates a front view of the edge cutting element shown in FIG. 6.

FIG. 9 shows a front view of the edge cutting element 20. The teeth 30*a*, 30*b*, 30*c* of the edge cutting element 20 can be orientated in a way on the arcuate base 26 so that each tooth 30*a*, 30*b*, 30*c* has a dissimilar cutting plane 33*a*, 33*b*, 33*c*. Each dissimilar cutting plane 33*a*, 33*b*, 33*c* may be parallel to one another and to the first side 46 and to the second side 47 of the arcuate base 26. In some embodiments, the dissimilar cutting planes 33*a*, 33*b*, 33*c* are substantially equidistantly spaced apart at the distance D. In the depicted embodiment, the leading tooth tip 32*a* can overhang the first side 46 of the arcuate base 26 and the trailing tooth tip 32*c* can overhang the second side 47 of the arcuate base 26.

The above specification, examples and data provide a complete description of the manufacture and use of the composition of the inventive aspects. Since many embodiments of the disclosure can be made without departing from the spirit and scope of the inventive aspects, the inventive aspects resides in the claims hereinafter appended.

What is claimed is:

1. A cutting element comprising:

an arcuate base having a forward end, a rearward end, an arc-shaped inner radial surface adapted to be mounted to a surface of a rotatable cutting drum, and an outer radial surface, the arcuate base further defining a length, the length being bisected by a vertical reference plane that runs along the length, the arcuate base further including first and second sides, the first and second sides being parallel to the vertical reference plane, the outer radial surface defining three discrete planar mounting surfaces, a first of the planar mounting surfaces facing partially towards the first side and partially away from the second side, a second of the planar mounting surfaces facing partially away from the first side and partially towards the second side;

a tooth holder mounted to each of the planar mounting surfaces, the three tooth holders being configured to receive cutting teeth;

a cutting tooth mounted in each tooth holder, wherein there is a leading tooth adjacent the forward end of the arcuate base, a trailing tooth adjacent the rearward end of the arcuate base and exactly one intermediate tooth disposed between the leading tooth and the trailing tooth, each of the cutting teeth having a tooth tip;

wherein the tooth tip of the leading tooth defines a first tooth tip location, the first tooth tip location being offset in a first direction from the vertical reference plane;

wherein the tooth tip of the trailing tooth defines a second tooth tip location, the second tooth tip location being offset in a second direction from the vertical reference plane, the second direction being opposite from the first direction; and wherein the tooth tip of the intermediate tooth defines a third tooth tip location relative to the vertical reference plane, the third tooth tip location being between the first and second tooth tip locations.

2. The cutting element of claim 1, wherein the first side is offset a first side offset distance from the vertical reference plane in the first direction, and wherein the first tooth tip location is offset a leading tooth tip distance from the vertical reference plane in the first direction, the leading tooth tip distance being greater than the first side offset distance; and wherein the second side is offset a second side offset distance from the vertical reference plane in the second direction, and wherein the second tooth tip location is offset a trailing tooth tip distance from the vertical reference plane in the second direction, the trailing tooth tip distance being greater than the second side offset distance.

3. The cutting element of claim 1, wherein the cutting element is configured so that a plurality of adjacently positioned cutting elements create a repeating cutting pattern, the cutting elements being positioned so that the forward end of one cutting element is adjacent the rearward end of an adjacent cutting element.

4. The cutting element of claim 1, wherein the arcuate base further defines a width and wherein the leading tooth tip, the intermediate tooth tip, and the trailing tooth tip are spaced at equidistant spacing across the width.

5. The cutting element of claim 4, wherein the equidistant spacing between each leading tooth tip, the intermediate tooth tip, and the trailing tooth tip is between 2.00 inches and 4.00 inches.

6. The cutting element of claim 5, wherein the equidistant spacing is equal to 3.77 inches.

7. The cutting element of claim 4, wherein the cutting element is configured so that a plurality of adjacently positioned cutting elements create a repeating cutting pattern, the cutting elements being positioned so that the forward end of one cutting element is adjacent the rearward end of an adjacent cutting element, and wherein the cutting pattern includes at least two minor offsets between the leading tooth tip and the intermediate tooth tip and between the intermediate tooth tip and the trailing tooth tip, respectively, wherein the two minor offsets are followed by a singular major offset between tooth tips, the major offset being representative of the cutting pattern transitioning between cutting elements and the major offset being equal to at least twice the offset distance of the minor offsets.

8. A cutting arrangement comprising:

a cutting drum, the cutting drum having two side edges, a middle portion, and a rotational cutting direction; and at least three identically configured edge cutting elements defining a cutting edge, the cutting edge being adjacent a side edge of the cutting drum, each edge cutting element including:

an arcuate base having a first side, a second side, an outer radial surface, and an inner radial surface, the inner radial surface being mounted to the cutting drum such that the at least three edge cutting elements are adjacently positioned on the cutting drum so that the forward end of one cutting element is adjacent the rearward end of an adjacent cutting element;

a plurality of tooth holders being mounted to the outer radial surface of the arcuate base, the tooth holders being configured to receive cutting teeth; and a cutting tooth mounted in each tooth holder, wherein there is a leading tooth, a trailing tooth, and an intermediate tooth, each of the cutting teeth defining a respective tooth central axis, each tooth being mounted in a given tooth holder so as to be rotatable about the tooth central axis thereof, wherein the tooth central axis of the leading tooth is configured to point at least partially in a first axial direction away from the middle of the cutting drum and at least partially in the rotational cutting direction of the cutting drum, wherein the tooth central axis of the trailing tooth is configured to point at least partially in a second axial direction toward the middle of the cutting drum and at least partially in the rotational cutting direction of the cutting drum, wherein the tooth central axis of the intermediate tooth is configured to point at least partially in a third axial direction between the first axial direction and the second axial direction and at least partially in the rotational cutting direction of the cutting drum, and wherein each of the at least three edge cutting elements creates the same cutting pattern with their respective cutting teeth when the drum rotates in the rotational cutting direction.

9. The cutting arrangement of claim 8, comprising exactly eight of the identically configured edge cutting elements, wherein the arcuate base of each of the eight edge cutting elements includes three tooth holders.

10. The cutting arrangement of claim 8, wherein, for each of the edge cutting elements, each cutting tooth is respectively configured and arranged to cut through a dissimilar cutting plane, and wherein each cutting plane is parallel to one another.

11. The cutting arrangement of claim 10, further comprising a series of interior cutting elements each defining a cutting plane, the interior cutting elements being arranged on the cutting drum.

12. The cutting arrangement of claim 11, wherein the dissimilar cutting planes of each edge cutting element are equidistantly spaced apart, and wherein the distance between a nearest interior cutting element cutting plane and the trailing tooth cutting plane is equal to the equidistant spacing separating each cutting plane of each edge cutting element.

13. The cutting arrangement of claim 10, wherein the dissimilar cutting planes of each edge cutting element are equidistantly spaced apart.

14. The cutting arrangement of claim 8, wherein each leading tooth of each edge cutting element overhangs the side edge of the cutting drum.

15. The cutting arrangement of claim 8, wherein the edge cutting elements are arranged on the drum to cut a repeating pattern every 45 degrees of rotation of the cutting drum.

16. The cutting arrangement of claim 8, wherein the edge cutting elements are configured to cut a cutting pattern that moves a cut material away from the side of the cutting drum during rotation of the cutting drum.

17. A cutting element comprising:

an arcuate base having a forward end, a rearward end, and an elongate axis, the arcuate base further having an outer radial surface, an inner radial surface adapted to be mounted to a surface of a rotatable cutting drum, and first and second sides, the first and second sides being parallel to the elongate axis, the outer radial surface defining a plurality of discrete planar mounting surfaces, a first of the planar mounting surfaces facing partially towards the first side and partially away from the second side, a second of the planar mounting surfaces facing partially away from the first side and partially towards the second side;

a tooth holder being mounted to each of the planar mounting surfaces, the tooth holders being configured to receive cutting teeth; and a cutting tooth mounted in each tooth holder, wherein there is a leading tooth adjacent the forward end of the arcuate base, and a trailing tooth adjacent the rearward end of the arcuate base, each of the cutting teeth defining a respective tooth central axis, wherein the tooth central axis of the leading tooth is configured to point at least partially in a first axial direction toward the first side of the arcuate base, at least partially in a first tangential direction toward the forward end of the arcuate base, and at least partially in a first radial direction away from the outer radial surface; and wherein the tooth central axis of the trailing tooth is configured to point at least partially in a second axial direction toward the second side of the arcuate base, at least partially in a second tangential direction toward the forward end of the arcuate base, and at least partially in a second radial direction away from the outer radial surface.

18. The cutting element of claim 17, wherein the arcuate base further includes fastener holes, the first and second sides being configured to accept wear elements secured thereto by a plurality of fasteners.

19. The cutting element of claim 17, wherein each of the cutting teeth is respectively configured and arranged to cut through a dissimilar cutting plane, wherein each dissimilar cutting plane is parallel to one another, and wherein the dissimilar cutting planes are equidistantly spaced apart.

20. The cutting element of claim 19, wherein the spacing between cutting planes is between 2.00 inches and 4.00 inches.

21. The cutting element of claim 20, wherein the cutting planes are spaced 3.77 inches apart.

22. The cutting element of claim 17, further comprising at least one intermediate tooth disposed between the leading tooth and the trailing tooth.

23. The cutting element of claim 17, further comprising at least two intermediate teeth disposed between the leading tooth and the trailing tooth.

24. The cutting element of claim 17, wherein each of the cutting teeth is rotatable about the tooth central axis thereof.

* * * * *